US006431730B1

(12) United States Patent
Deutsch et al.

(10) Patent No.: US 6,431,730 B1
(45) Date of Patent: Aug. 13, 2002

(54) DECORATIVE LIGHT CURTAIN

(75) Inventors: Daniel Deutsch, New York City, NY (US); Stephen L. Fillipp; Chad H. Jones, both of Lubbock, TX (US)

(73) Assignee: Emerald Innovations, L.L.C., Butler, PA (US)

( * ) Notice: Subject to any disclaimer, the term of this patent is extended or adjusted under 35 U.S.C. 154(b) by 0 days.

(21) Appl. No.: 09/779,723

(22) Filed: Feb. 8, 2001

(51) Int. Cl.[7] ..... F21S 4/00; F21V 21/02

(52) U.S. Cl. ..... 362/252; 362/145; 362/249; 362/432; 362/806

(58) Field of Search ..... 362/145, 151, 362/152, 227, 249, 252, 391, 432, 806

(56) References Cited

U.S. PATENT DOCUMENTS 1,640,282 A * 8/1927 Migliaccio ..... 362/252
5,931,561 A * 8/1999 Broderick ..... 362/145
6,155,697 A * 12/2000 Ahroni ..... 362/252
6,231,210 B1 * 5/2001 Pendergrass ..... 362/249
6,296,374 B1 * 10/2001 Ahroni ..... 362/252

* cited by examiner

*Primary Examiner*—Alan Cariaso
(74) *Attorney, Agent, or Firm*—Jeanne E. Longmuir; Calfee, Halter & Griswold LLP

(57) ABSTRACT

A decorative light curtain that can be draped inside a doorway, window or other opening using a conventional tension rod and a plurality of specially adapted light support brackets that separate and position a plurality of substantially parallel strands of decorative lights. The resultant lighting display simulates a lighted drape that spans the top and each side of the door or window in which it is used.

20 Claims, 3 Drawing Sheets

DECORATIVE LIGHT CURTAIN

BACKGROUND OF THE INVENTION

1. Field of the Invention

This invention relates to a decorative lighting product, and more particularly, to a decorative lighting product simulating a lighted curtain that is draped inside a doorway to achieve an aesthetic decorative effect.

2. Description of Related Art

Decorative light strings comprising a plurality of decorative bulb and socket assemblies linked by insulated electrical wires are well known. Such decorative light strings are ordinarily sold with clear, white or colored C-9, C7 or mini-light sized bulbs in 25, 50 or 100 count strings. In the past, doorways and large windows have often been decorated for seasonal, holiday or other occasional use by attaching such decorative light strings around the perimeter using hooks or other fasteners. Generally, not more than one or two strands of lights are strung along each side because of the time and trouble required to install and remove the light strings.

The use of stranded curtains in doorways is also well known. Such strands, often made of strings of beads, typically hang downward from the top of the doorway, and are parted by the user when passing through the doorway.

There remains a need, however, for a decorative lighting treatment for doorways and windows that comprises multiple strands of decorative lights that can be quickly and easily installed and then removed following use.

SUMMARY OF THE INVENTION

The invention disclosed herein is a decorative light curtain that can be draped inside a doorway, window or other interior or exterior wall opening using a conventional tension rod and a plurality of specially adapted light support brackets that separate and position a plurality of strands of decorative bulb and socket assemblies. The subject curtain drape lights are preferably totally or partially preassembled so that they can be quickly installed and used following removal from the packaging in which they are sold. The resultant lighting display simulates a lighted curtain or drape that spans the top and at least part of each side of the door, window or other wall opening in which it is used.

According to one preferred embodiment of the invention, the subject decorative light curtain comprises a transverse rod capable of being biased against structural members disposed at each side of a doorway, window or other opening, thereby spanning the opening; a light support bracket suspended from the transverse rod at or near each end of the rod and angled downwardly and inwardly into the doorway, window or opening, each angled light support bracket further comprising a plurality of laterally spaced positioning members each adapted to receive, releasably engage, support and separate a strand of lights from other such light strands in generally parallel relation to each other; a plurality of serially interconnected light strands draped between and downwardly from the angled brackets; and means for supplying electrical energy to the serially connected light strands.

According to yet another preferred embodiment of the invention, at least one additional light support bracket is also provided at each side of the doorway, window or other opening to provide continued separation between adjacent strands suspended from the angled brackets as disclosed above. Such additional light support brackets can be releasably attached to the sides of the doorway, window or opening, or can be clipped to and suspended from the decorative light strands.

Where the width of the doorway, window or other opening is substantial, such as, for example, greater than about three feet, a device is also desirably provided near the middle of the tension rod that can be used to gather the substantially parallel light strands closer together in proximity to the rod.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
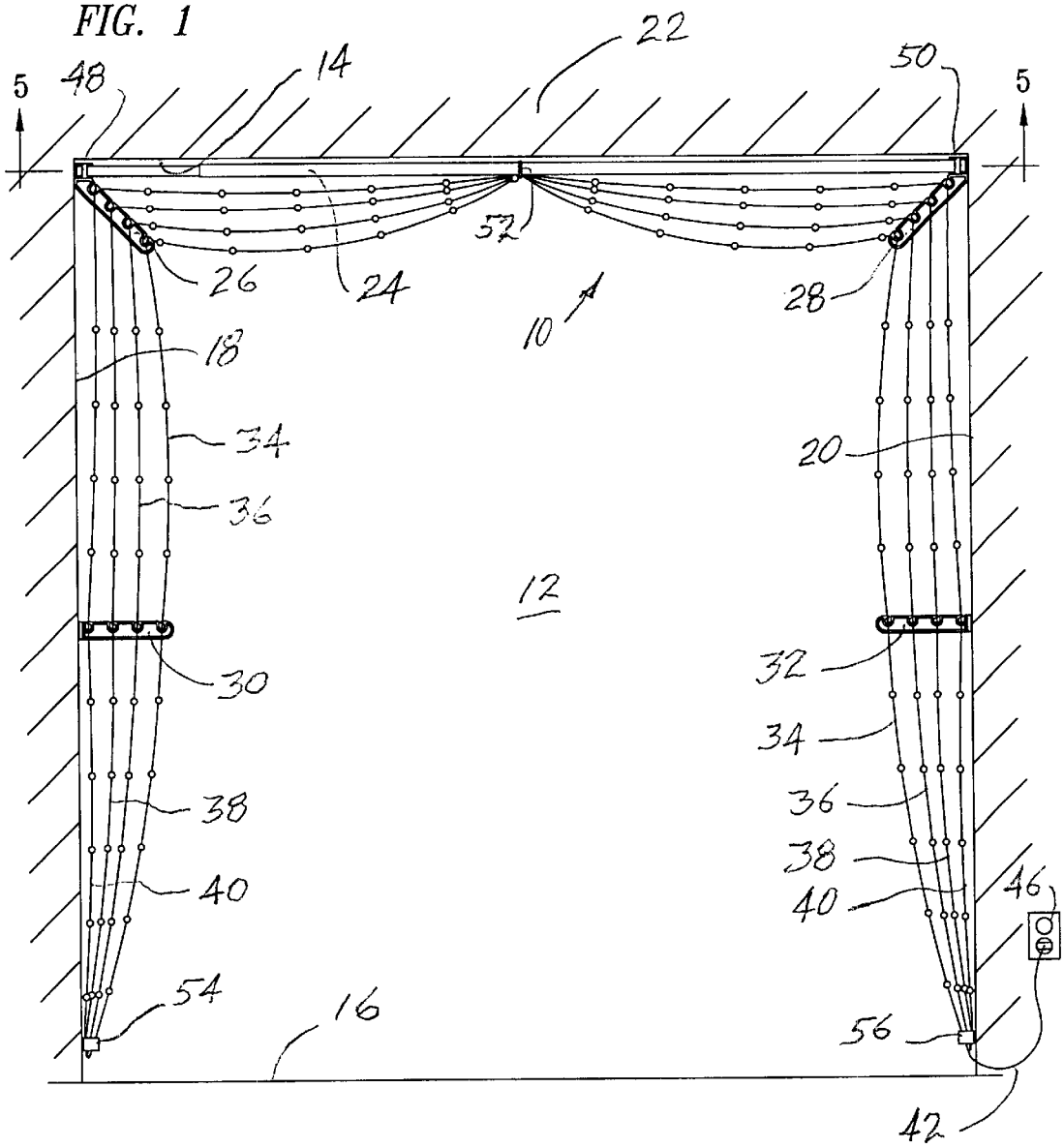
FIG. 1 is a simplified front elevation view depicting the curtain drape lights of the invention as installed in a doorway.
Figure 1A:
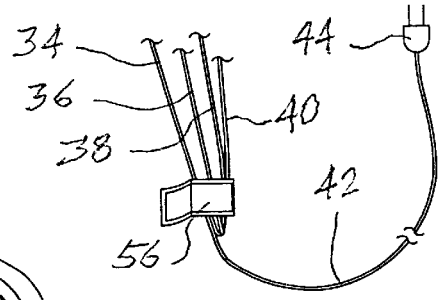
FIG. 1A is an enlarged detail view depicting four light strands gathered by a tie near the bottom, with one of the strands having at its end a plug for connecting the light strands to an electrical power source.

Referring to FIGS. 1 and 1A, decorative light curtain 10 of the invention is preferably installed inside an interior or exterior door, window or other wall opening 12 having a top 14, bottom 16 and sides 18, 20. It will be appreciated upon reading this disclosure, however, that the invention can also be installed around or over such an opening if desired. In such cases, additional commercially available mounting brackets may be required to attach decorative light curtain 10 to wall 22. Decorative light curtain 10 preferably comprises transverse rod 24, top light support brackets 26, 28 disposed at or near the ends of transverse rod 24, side support brackets 30, 32 and substantially parallel light strands 34, 36, 38, 40.

Light strands 34, 36, 38, 40 are most preferably part of a single decorative light string having, for example, 100 decorative mini-light bulb and socket assemblies that are longitudinally spaced and interconnected with insulated electrical conductors. Near bottom 16 on each side of opening 12, the decorative light string can be doubled or folded to reverse its direction, thereby creating the appearance of a different light strand. It will be appreciated, however, that the number of lights can vary as desired and that several shorter decorative light strings can also be joined end-to-end to produce the desired number of strands. At least one light strand 34 will desirably terminate in a pigtail 42 having a plug 44 or other connector suitable for connecting the light strand to an electrical power source such as wall outlet 46.

According to a particularly preferred embodiment of the invention decorative light curtain 10 is substantially preassembled to permit easy installation by the user when removed from the packaging in which it is purchased. Thus, for example, top light support brackets 26, 28 are preferably attached to ends 48, 50, respectively, of transverse rod 24, and light strands 34, 36 38, 40 are preferably inserted into receiving positions on the brackets during manufacture. To install decorative light curtain 10, the user only needs to install transverse rod 24 in opening 12 near top 14, and insert plug 44 into wall outlet 46. Side support brackets 30, 32, which are preferred but not required for use with the invention, also comprise laterally spaced receiving positions as described in greater detail below, that can be used to maintain desired separation between the portions of adjacent light strands 34, 36, 38, 40 that hang from top support brackets 26, 28. Side support brackets 30, 32 can also be attached to sides 18, 20 to enhance the aesthetic appearance of decorative light curtain 10 if desired.

Depending upon the width of opening 12, a support 52 can be provided near the midpoint of transverse rod 24 to gather light strands 34, 36, 38, 40 where they are draped between top light support brackets 26, 28. Support 52 can be a hook or clasp attached to transverse rod 24, or can be a cord or a fabric tie with an appropriate fastener such as a hook and loop fastener system. Similarly, ties 54, 56 can be provided for use near the bottom of light strands 34, 36, 38, 40 at each side of opening 12 to gather the downwardly depending portions of the light strands together, thereby creating a cleaner look, minimizing risk of entanglement with a passer-by and concealing the doubling of looped strands.

Figure 5:
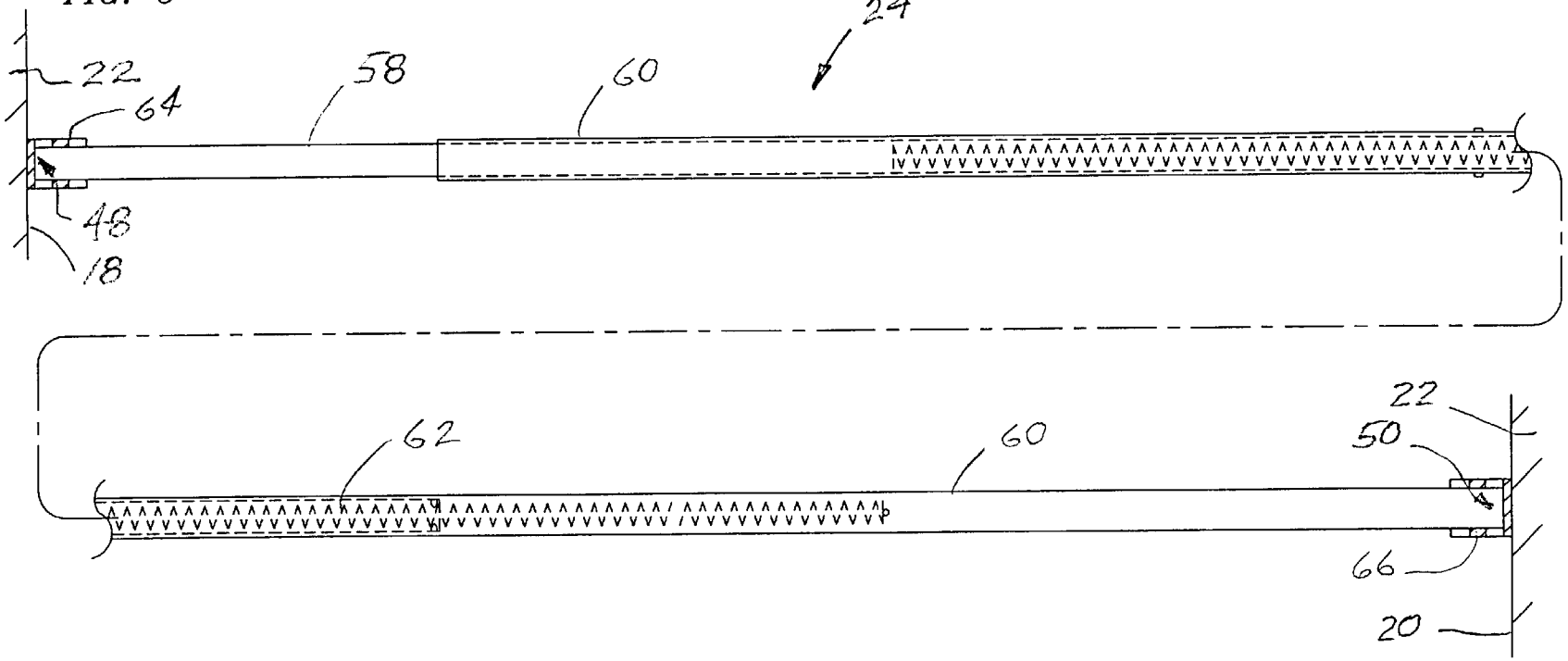
FIG. 5 is a simplified front elevation view, partially broken away, of a preferred tension rod suitable for use in the apparatus of the invention.

Referring to FIGS. 1 and 5, transverse rod 24 is preferably a spring-biased, telescoping tension rod having a first, smaller diameter tubular section 58 slidably inserted into a second, larger diameter tubular section 60 that contains spring 62. The use of such a transverse rod 24 facilitates convenient installation inside wall openings of various widths and quick removal following use. Use of a sectioned or telescoping transverse rod 24 can also facilitate packaging of decorative light curtain 10 in a shorter package. Non-skid rubber end caps 64, 66 can optionally be provided on ends 48, 50 if desired to facilitate engagement with sides 18, 20 of wall 22. While the use of such an outwardly biased, adjustable length rod is preferred, it will be appreciated that other similarly effective rod supports can likewise be used with decorative light curtain 10 of the invention. For example, a single length rod having threaded, adjustable end tips at rod ends 48, 50 can also be used, as can a rod that is simply mounted over a doorway, window or other opening using conventional mounting hardware.

Figure 3:
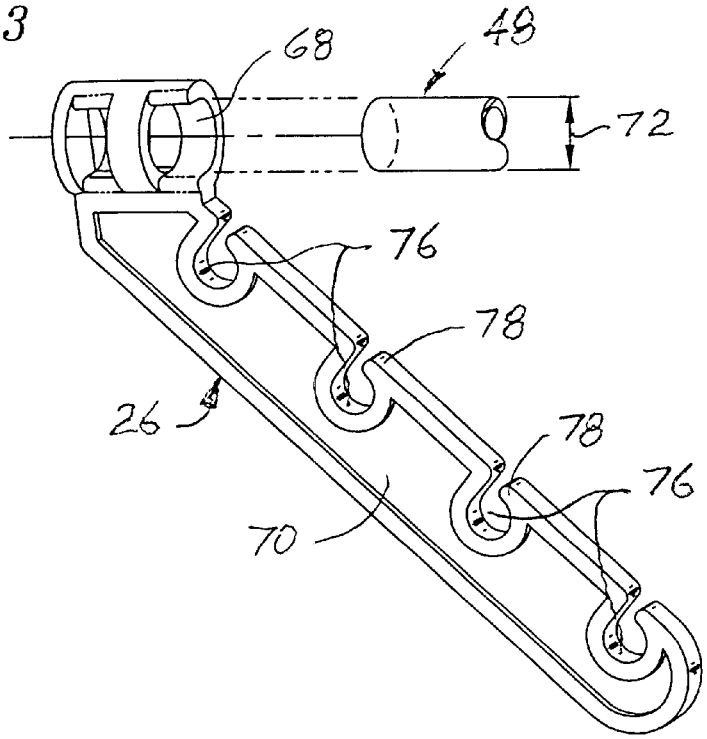
FIG. 3 is a front perspective view of a preferred embodiment of a light support bracket useful for supporting a plurality of decorative light strands in spaced-apart relation at one end of a tension rod installed inside a doorway, window or other opening, substantially as depicted in FIG. 1.
Figure 4:
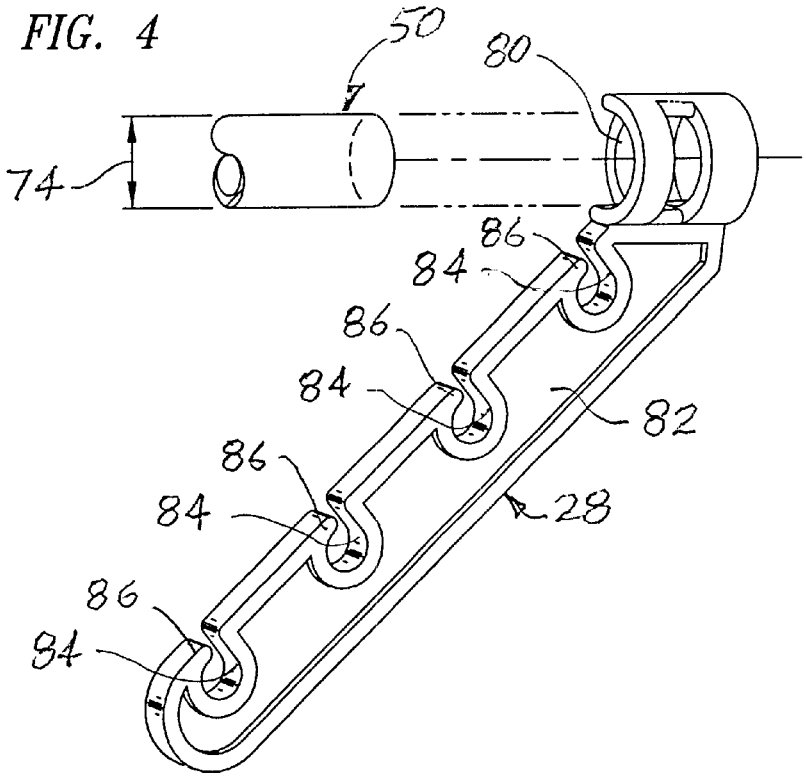
FIG. 4 is a front perspective view of another light support bracket that is similar to the bracket depicted in FIG. 3, but designed for use on the opposite end of a tension rod as the bracket depicted in FIG. 3, and having a cylindrical receptacle with a slightly larger diameter to accommodate the larger-diameter section of the tension rod.

Referring to FIGS. 3 and 4, top light support brackets 26, 28 are preferably made of molded plastic, although brackets made of other materials such as metal are similarly useful. Top light support brackets 26, 28 preferably comprise cylindrical barrel sections 68, 80 having inside diameters sized to receive and provide slidable, frictional engagement with transverse rod ends 48, 50 having outside diameters 72, 74, respectively. Top light support brackets 26, 28 preferably further comprise elongated strand-support sections 70, 82, respectively, each of which embodies a plurality of spaced-apart receiving positions, depicted as positions 76, 84, respectively, that are adapted to receive and support light strands of decorative light strings in substantially parallel and spaced-apart relation to each other. According to a particularly preferred embodiment of the invention, elongated strand-support sections 70, 82 of top light support brackets 26, 28 extend downwardly and angle inwardly into opening 12 as shown in FIG. 1 to produce a preferred orientation, separation and aesthetic effect with light strands 34, 36, 38, 50. Receiving positions 76, 84 are merely exemplary of many types of receptacles, fasteners, clips and the like that can be provided on top light support brackets 26, 28 to receive and maintain a plurality of light strands in a preferred, space-apart alignment to each other. As depicted in FIGS. 3 and 4, receiving positions 76, 84, are recesses partially occluded by lips 78, 86, respectively. Overhanging lips 78, 86 help maintain light strands 34, 36, 38, 40 in preferred alignment and separation while permitting quick and convenient insertion of light strands into receiving positions 76, 84 during manufacture, assembly or installation of decorative light curtain 10 of FIG. 1. When top light support brackets 26, 28 are attached or attachable to transverse rod 24, and when light strands 34, 36, 38, 40 are inserted into receiving positions 76, 84 during manufacture, decorative light curtain 10 of FIG. 1 can be quickly installed following removal from the packaging in which is it sold. It should be understood that, while four substantially parallel and spaced-apart light strands 34, 36, 38, 40 are depicted in FIG. 1, the number of light strands and associated receiving positions in the light brackets can be increased or decreased from those shown within the scope of the invention. The use of at least three light strands is preferred.

Figure 2:
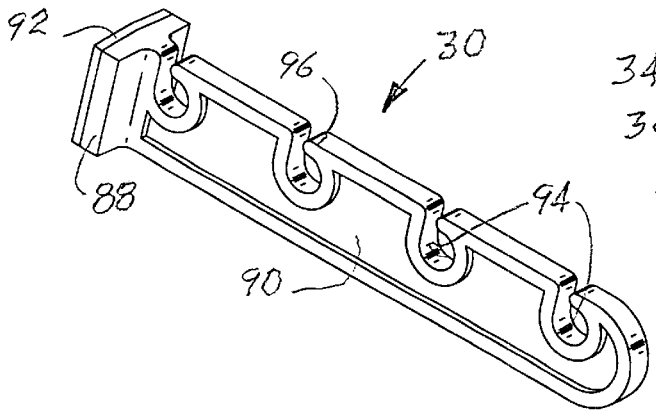
FIG. 2 is a front perspective view of a preferred embodiment of a light support bracket useful for supporting a plurality of decorative light strands in substantially parallel, spaced-apart relation to each other at the side of a doorway, window or other opening.

Referring to FIG. 2, a preferred side support bracket 30 is shown that comprises a mounting section 88 and a light strand support section 90. While the use of side support brackets 30, 32 as shown in FIG. 1 is not required, such brackets assist in maintaining separation and alignment of the light strands. For taller openings, more than one side support bracket 30 can be used on each side of the opening in which the subject decorative light curtain is installed. Mounting section 88 preferably comprises an adhesive pad 92 or other similarly effective means for attaching side support bracket 30 to side 18. Mounting section 88 is preferably designed in such manner that side support bracket 30 is releasable and removable from wall 22 without permanent damage following use. As shown in FIG. 2, side support bracket 30 preferably comprises a plurality of laterally spaced receiving positions 94 with openings partially occluded by overhanging lips 96 as previously described in relation to top light support brackets 26, 28. According to another embodiment of the invention, side support brackets can be provided that do not include a mounting section 88. Such side support brackets will desirably comprise receiving positions 94 that attach to light strands in such manner that the brackets will remain in place and maintain separation of the light strands without sliding down the strands.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A decorative light curtain installable inside a wall opening having a top, bottom and sides, the light curtain comprising:

a transverse support rod having sufficient length to substantially spanning the opening and having first and second ends, the rod being supportable near the top of the opening;

first and second light support brackets attachable to the support rod near the first and second ends, respectively, the first and second brackets extending downwardly into the opening from the support rod and further comprising a plurality of spaced-apart receiving positions; and a plurality of substantially parallel light strands, each light strand comprising insulated electrical conductors and a plurality of decorative bulb and socket assemblies longitudinally spaced along the strands, the strands spanning the opening between the first and second brackets with each strand being supported at one of the receiving positions of each bracket and a portion of each strand draping downwardly from each bracket near a side of the opening, each strand having an electrical connection to at least one other strand, and at least one of the strands further comprising a connector attachable to an electrical power source.

2. The decorative light curtain of claim 1 wherein the wall opening is one of an interior or an exterior building opening.

3. The decorative light curtain of claim 2 wherein the wall opening is one of a window opening or a door opening.

4. The decorative light curtain of claim 1 wherein the transverse rod is a tension rod.

5. The decorative light curtain of claim 4 wherein the tension rod is spring-biased.

6. The decorative light curtain of claim 5 wherein the tension rod has telescoping sections.

7. The decorative light curtain of claim 1 wherein the transverse rod is supportable inside the opening.

8. The decorative light curtain of claim 1 wherein the first and second brackets are connected to the first and second ends, respectively, of the transverse rod.

9. The decorative light curtain of claim 1 wherein the first and second brackets are angled downwardly and inwardly into the opening.

10. The decorative light curtain of claim 1 wherein the first and second brackets each comprise four spaced-apart receiving positions.

11. The decorative light curtain of claim 1 wherein each receiving position is a partially occluded curvilinear recess.

12. The decorative light curtain of claim 1 wherein the receiving positions are laterally spaced.

13. The decorative light curtain of claim 1 wherein at least two of the substantially parallel light strands are a continuous decorative light string that is doubled near the bottom at one side of the opening.

14. The decorative light curtain of claim 13 wherein all the light strands are part of a single decorative light string.

15. The decorative light curtain of claim 1 where all the light strands are serially interconnected.

16. The decorative light curtain of claim 1, further comprising third and fourth light support brackets, each of the third and fourth light support brackets having a plurality of spaced-apart receiving positions, each receiving position adapted to receive and releasably engage a light strand hanging from a receiving position of one of the first and second light support brackets.

17. The decorative light curtain of claim 16 wherein one of the third and fourth light support brackets is disposed at each side of the opening.

18. The decorative light curtain of claim 16 wherein each of the third and fourth light support brackets is releasably connected to one side of the opening.

19. The decorative light curtain of claim 1, further comprising an intermediate strand support member that supports the light strands from the transverse rod between the first and second light support brackets.

20. The decorative light curtain of claim 1, further comprising a tie member that gathers the light strands near the bottom at each side of the opening.

* * * * *